US006152985A

United States Patent [19]

Allen

[11] Patent Number: 6,152,985

[45] Date of Patent: Nov. 28, 2000

[54] ORE PELLETIZATION

[75] Inventor: Anthony Peter Allen, Shipley, United Kingdom

[73] Assignee: Ciba Specialty Chemicals Water Treatments Limited, Bradford, United Kingdom

[21] Appl. No.: 09/190,526

[22] Filed: Nov. 12, 1998

[30] Foreign Application Priority Data

Nov. 13, 1997 [GB] United Kingdom ..... 9724032

[51] Int. Cl.[7] ..... C22B 1/244

[52] U.S. Cl. ..... 75/767

[58] Field of Search ..... 75/767, 772

[56] References Cited

U.S. PATENT DOCUMENTS

| | | | |
|---|---|---|---|
| 5,093,091 | 3/1992 | Dauplaise et al. | 423/112 |
| 5,147,452 | 9/1992 | Anderson et al. | 75/767 |
| 5,368,745 | 11/1994 | Rothenberg et al. | 210/734 |
| 5,435,834 | 7/1995 | Allen | 75/767 |
| 6,011,089 | 1/2000 | Davies et al. | 523/335 |

FOREIGN PATENT DOCUMENTS

| | | |
|---|---|---|
| 0288150 | 10/1988 | European Pat. Off. . |
| 0228150 | 3/1991 | European Pat. Off. . |
| 0347424 | 3/1992 | European Pat. Off. . |
| 0203854 | 8/1992 | European Pat. Off. . |
| 0225171 | 8/1993 | European Pat. Off. . |
| 1324838 | 7/1973 | United Kingdom . |
| 9303190 | 2/1993 | WIPO . |
| 97/17293 | 5/1997 | WIPO . |

*Primary Examiner*—Roy V. King
*Assistant Examiner*—Tima McGuthry-Banks
*Attorney, Agent, or Firm*—David R. Crichton

[57] ABSTRACT

A process is provided for pelletising a metal ore comprising forming an intimate mixture of particulate ore and a binder in the presence of moisture, forming green pellets by agitation of the mixture and firing the green pellets to produce ore pellets. In the process the binder comprises a hydroxamate polymer made from water-soluble ethylenically unsaturated monomer or monomer blend and which has pendant groups of the formula

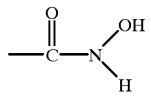

This provides advantages in wet strength, dry strength and drop number of pellets, especially at low moisture content of the pellets.

9 Claims, No Drawings

ORE PELLETIZATION

This invention relates to the pelletisation of metal ores.

The standard method of pelletising an ore comprises forming an intimate mixture of the ore in particulate form and a binder in the presence of moisture, forming green pellets by agitation of the mixture (for instance by rolling or tumbling) and firing the green pellets to produce ore pellets.

Bentonite has been a widely used particulate binder but its use has some undesirable consequences. Also, there is decreasing availability of suitable grades of bentonite. There have been numerous proposals to use synthetic or natural organic polymers to replace part or all of the bentonite.

In GB 1,324,838 solutions are used of water soluble polymers which can be non-ionic, anionic or cationic. In EP-A-203,854 various polymers are proposed as binders and include water-in-oil emulsion polymers and powder polymers formed of acrylamide and sodium acrylate. In EP-A-225,171 particular powdered polymers of acrylamide and, for instance, sodium acrylate are proposed. In EP-B-288,150 certain cationic polymers are proposed as binders for acidic ores, such as haematite. The polymer can be added as a solution or can be added as a polymer-in-oil dispersion or as a powder, optionally with additional moisture to promote pelletisation. The use of polymers made with a small amount of cross linker is described in W093/03190.

It is well established to use binders which consist of a blend of natural or synthetic polymer, such as any of those discussed above, with certain inorganic components such as sodium carbonate or calcium oxide (both of which are mentioned in EP-B-288,150). The inclusion of lime as a flux during pelletisation is well known, but lime can interact undesirably with some organic binders.

The pellets that are obtained are judged by various physical tests that are intended to be indicative of actual performance in use. These tests include measurement of the wet strength, the dry strength and the drop number. The measured values may be influenced significantly by the moisture content of the pellet and so the relevant values are those which are obtained at moisture contents which are conveniently available for the particular ore and the particular pelletisation process that is being used.

In general it is desirable to increase the wet strength, increase the dry strength and increase the drop number. Existing binder systems tend to give adequate wet and dry strength at convenient moisture contents for a range of ores but may give a rather low drop number, especially at low moisture contents.

Other relevant properties are the amounts of moisture and metal oxide on the surface of the pellets. For instance these can be estimated by contacting the pellets with a filter paper. In general, it is desirable for these values to be as low as possible.

A wide range of metal ores may be pelletised, including for instance zinc ores and various iron ores, including haematite, magnetite and taconite. Existing binders, such as those described in EP-A-225,171, are very satisfactory for many ores and in many pelletisation processes, but may be less satisfactory if the moisture content is not held at the optimum for that particular ore or if the optimum for that ore is rather low for that particular plant. For instance satisfactory operation at many plants generally requires the moisture content to be at least 8.5% or 9% but some ores are pelletised more effectively at moisture contents below this. This problem of needing to pelletise at a low moisture content occurs with various types of ores, but especially with some haematite ores.

It would be desirable to be able to achieve satisfactory pelletisation, and in particular to obtain improved drop number whilst maintaining adequate wet and dry strength, under conditions that would normally be considered to be adverse for the use of synthetic polymeric binders, such as in the presence of lime and/or at a moisture content which is less than would normally be considered to be suitable.

In the invention, we pelletise a metal ore by a process comprising forming an intimate mixture of particulate ore and a binder in the presence of moisture, forming green pellets by agitation of the mixture and firing the green pellets to produce ore pellets, wherein the binder comprises a polymer made from water soluble ethylenically unsaturated monomer or monomer blend and which has pendent groups of the formula

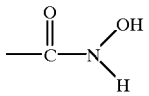

The pendent groups are hydroxamic derivatives of (meth) acrylamide groups and so it is convenient to refer to the polymer as a hydroxamated (meth) acrylamide polymer.

The process of the invention can result in improved pelletisation properties as manifested especially by drop number, and also surface properties, even though the moisture content may be unusually low, and lime may be present.

The polymer can be made by polymerisation of the hydroxamic derivative of (meth) acrylamide but preferably it is made by hydroxamating previously formed (meth) acrylamide polymer.

The polymer consists of recurring units of which at least 20 mol % are hydroxamated (meth) acrylamide units. The amount is preferably at least 50 mol % and usually it is at least 75 mol %. It can be 90 or 100 mol %.

The amount of (meth) acrylamide units can be as much as 80 mol % but is usually below 50 mol % and is preferably below 20 mol %. Often it is 0 to 5 mol %. It is generally preferred for the amount of non-hydroxamated (meth) acrylamide units to be as low as possible and the amount of hydroxamated units to be as high as possible.

The pendent groups are preferably hydroxamated acrylamide groups rather than hydroxamated methacrylamide groups.

The polymer may include other recurring units, usually units of water soluble monomer, for instance anionic units such as acrylic acid or other ethylenically unsaturated carboxylic acid. The anionic units are generally in the form of the sodium or other alkali metal or ammonium salt.

Preferred polymers are formed by essentially complete hydroxamation of copolymers of 0 to 50 mol %, preferably 1 to 20 (for instance 2 to 10) mol % sodium acrylate with the balance acrylamide.

The polymers can be essentially linear in that they are made without the deliberate addition of any cross linking agent. However good results can be obtained when the polymers are branched or even crosslinked, for instance as a result of polymerisation in the presence of a small amount of polyethylenically unsaturated or other cross linking agent. The amount of cross linking agent must not be too high and so is generally below 500 ppm, usually in the range 10 to 300 ppm.

The polymer typically has intrinsic viscosity above 4 dl/g, often in the range 5 to 13 dl/g. In this specification, intrinsic viscosity is measured by a suspended level viscometer in a 1N sodium chloride solution at 25° C. buffered to pH7.

The polymer can be added to the pelletisation mixture in the form, for example, of an aqueous solution or a reverse phase emulsion (i.e., polymer, or aqueous polymer, dispersed in oil).

The hydroxamated polymer is preferably made by providing the acrylamide polymer having an appropriate IV and degree of linearity or cross linking and then subjecting this polymer to hydroxamation, for instance using techniques as described in EP-A-347,424. The process is preferably conducted while the acrylamide polymer is in the form of a solution or an emulsion in oil of aqueous polymer. The process generally comprises mixing the polymer solution or emulsion with a suitable source of hydroxylamine such as hydroxylamine hydrochloride, allowing the mixture to stand (with stirring) for a suitable period of time generally of up to about an hour, adding alkali to provide an alkaline pH which is generally above about pH 12, allowing the mixture to stand again with stirring for typically up to about an hour and then leaving it to stand, optionally with occasional stirring, for sufficient time to allow reaction to occur, for instance for more than half a day, typically 24 hours. The resultant product can then be used directly as the binder in the invention, without any intermediate treatment stages.

It is particularly preferred for the polymer to be a reverse phase dispersion. This can be made by reverse phase emulsion polymerisation of acrylamide, optionally with other monomer, under conditions which give the desired particle size. The reverse phase emulsion can have a typical particle size in the range 90% by weight of the particles between 0.3 and 3 $\mu$m but often the particle size is smaller, for instance 90% by weight between 0.05 and 0.8 $\mu$m, often about 0.1 to 5 $\mu$m. In particular it is preferably of a size such that it may be referred to as a microemulsion.

The emulsion, after the conversion with hydroxylamine hydrochloride, typically has a polymer content of 10 to 30 weight percent, a water content of 20 to 40 wt % and an oil content of 25 to 55 wt % and surfactant content of 10 to 20 wt %.

The oil phase can be any suitable oil phase that is conventional for use in reverse emulsions and can include conventional emulsifier and/or polymeric amphipathic stabiliser. The storage stability of the hydroxamated emulsion will depend on the components of the emulsion. Selection of a surfactant (or surfactant blend) having HLB in the range 8 to 10, preferably about 8.7 to 9.4, can be beneficial in this respect.

The ore that is to be pelletised can be any convenient metal ore such as zinc ore or iron ores which can be taconite, magnetite or, preferably, haematite.

The ore is normally provided to a particle size which is conventional for pelletisation, usually 90% being below 250 microns and preferably 90% by weight being below 75 microns.

The amount of polymer that is added, based on the amount of ore, is generally 0.01 to 0.2%, often 0.02 to 0.1% and preferably 0.025 to 0.075% based on the dry weight of polymer.

The total moisture content of the mixture that is to be pelletised is generally in the range 5 to 11% by weight of the ore. The amount is often in the range 6 to 8.5 or 9% frequently 6.5 to 8.3%. The amount is usually at least 1% below, and often 2 to 4% below, the amount that is optimum when using powdered binders such as acrylamide-sodium acrylate copolymer. If the polymer is added as a solution or reverse phase aqueous emulsion then it will provide some or all of the water that is required for pelletisation. Often, however, at least some of the moisture is present as moisture in the ore, and extra water may be added if required at the pelletisation stage to provide the desired moisture content.

The invention is of particular value when an inorganic component is included as part of the binder. The inorganic component can be any of the materials listed in, for instance, EP-A-288,150 and may be included in a dry weight ratio of polymer:additive of from 3:1 to 1:3. Preferably, however, the binder includes calcium oxide or calcium hydroxide. Preferably it is provided as hydrated lime but crushed limestone can be used in the invention. Lime may be added in the form of slurry. Lime or other inorganic binder may be added simultaneously with the polymer or sequentially in either order. The amount of lime is typically in the range 0.5 to 5%, often 1 to 2.5%, by weight of the mix to be pelletised.

Further inorganic components, for instance salts such as sodium carbonate, may also be added in a dry weight ratio of polymer:salt of from 3:1 to 1:3. Preferably such salts are mixed with the polymer prior to pelletisation.

The process of the invention not only has the advantage of giving good drop number despite low moisture content and despite the presence of lime in the mix that is being pelletised, but also gives pellets having desirable surface properties, for instance having low amounts of moisture and metal oxide powder contaminating the surfaces.

The following are examples.

EXAMPLE 1

A haematite ore containing 2.9% moisture as supplied was mixed with tap water to produce a 7.0% moisture content and then bagged up and allowed to stand overnight. Prior to pelletisation 1.8% (based on weight of ore) lime+ appropriate binder was premixed where possible and added or added separately at the same time over 1 minute with a further 4 minutes mixing permitted. The concentrate was pelletised in conventional manner and the resultant green pellets produced (−13.2+11.2mm) were retained for standard pellet tests.

The following binders were used in this example. Binders A and B are according to the invention.

A 16.9% solids microemulsion of a fully hydroxamated copolymer of 95 wt % acrylamide/5 wt % sodium acrylate the intrinsic viscosity (IV) of the hydroxamated copolymer being 7.2 dl/g.

B As A but the acrylamide polymer was cross linked with 100 ppm methylene bis acrylamide (MBA) and the IV of the hydroxamated polymer was 5.5 dl/g.

C Guar gum.

D Non-ionic corn starch (Chemstar 1908G).

E Powdered copolymer of 50 wt % AMPS/50 wt % acrylamide, IV 5.0 dl/g.

F As E, but IV 8.6 dl/g.

The wet and dry strength and drop number values were recorded. The results are given in the following Table 1.

TABLE 1

| Binder | % Dose | % Active Dose | Strength/kg Wet | Strength/kg Dry | Drop Number | % Change in Drop Number | % Moisture |
|---|---|---|---|---|---|---|---|
| — | — | — | 1.17 | 1.99 | 4.3 | — | 7.0 |
| A | 0.355 | 0.06 | 1.01 | 1.90 | 5.9 | +37% | 7.2 |
| B | 0.355 | 0.06 | 1.07 | 1.98 | 4.6 | +7% | 7.0 |
| C | 0.20 | 0.20 | 1.13 | 2.99 | 3.1 | −28% | 7.2 |
| D | 0.20 | 0.20 | 1.18 | 2.85 | 3.3 | −23% | 7.1 |
| E | 0.06 | 0.06 | 0.97 | 1.64 | 3.5 | −19% | 7.3 |
| F | 0.06 | 0.06 | 1.27 | 2.88 | 3.4 | −21% | 7.1 |

These results show that although acceptable wet and dry strengths can be obtained using lime alone and the binders C, D, E and F, only the polymers A and B of the invention gave useful increase in drop number. These increases are particularly valuable at the low moisture contents which are used in this example.

EXAMPLE 2

Testing was carried out as in Example 1 with the exception that the haematite ore was mixed with tap water to produce a 7.5% moisture content.

The following binders were used in this example. Binder B is the same as Binder B used in Example 1 and is according to the invention.

G 50% active dispersion of high molecular weight (IV 16.0 dl/g) copolymer of 35 wt % sodium acrylate/65 wt % acrylamide.

H Modified starch National B38.

I Powdered medium molecular weight (IV 6.3 dl/g) sodium acrylate homopolymer.

J Powdered copolymer of 30 wt % dimethylaminoethyl acrylate quaternised with NaCl/70 wt % acrylamide, IV 7.3 dl/g.

K Dextran flakes.

The wet and dry strength and drop number values were recorded. The results are given in the following Table 2.

TABLE 2

| Binder | % Dose | % Active Dose | Strength/kg Wet | Strength/kg Dry | Drop Number | % Change in Drop Number | % Moisture |
|---|---|---|---|---|---|---|---|
| — | — | — | 1.15 | 2.88 | 3.4 | — | 6.7 |
| B | 0.355 | 0.06 | 1.01 | 1.74 | 6.1 | +79% | 7.4 |
| G | 0.06 | 0.03 | 0.93 | 2.82 | 3.1 | −9% | 7.1 |
| H | 0.20 | 0.20 | 1.20 | 2.81 | 3.4 | — | 6.9 |
| I | 0.06 | 0.06 | 1.06 | 2.31 | 4.1 | +20% | 7.3 |
| J | 0.06 | 0.06 | 1.05 | 2.90 | 4.0 | +18% | 7.6 |
| K | 0.06 | 0.06 | 1.23 | 2.60 | 3.5 | +3% | 7.6 |

Again these results show that the Binder B according to the invention gives the best increase in drop number. In particular, it gives a better increase in drop number than polymers I, J and K, for which the pellets had similar or greater moisture content (increased moisture content tends to increase drop number).

EXAMPLE 3

Tests were carried out as in Example 1 except that the haematite ore was mixed with tap water to produce an 8.0% moisture content and prior to pelletisation 1.9% lime was used together with the appropriate binder.

The following binders were used in this example. Binders O and P are according to the invention. Binder G is the same as Binder G used in Example 2.

L Powdered copolymer of 20 wt % sodium acrylate/80 wt % acrylamide, IV 6.0 dl/g; contains 50 wt % sodium carbonate.

M As L but without sodium carbonate and with a small amount of MBA cross-linking.

N 40% active solution of 80 wt % AMPS/20 wt % sodium acrylate, low molecular weight.

O 17.7% solids microemulsion of a fully hydroxamated copolymer of 95 wt % acrylamide/5 wt % sodium acrylate, the IV of the hydroxamated copolymer being 8.6 dl/g.

P As O but the acrylamide copolymer was cross-linked with 100 ppm methylene bis acrylamide (MBA) and the IV of the hydroxamated polymer was 6.6 dl/g.

The wet and dry strength and drop number values were recorded. The results are given in the following Table 3.

TABLE 3

| Binder | % Dose | % Active Dose | Strength/kg Wet | Strength/kg Dry | Drop Number | % Change in Drop Number | % Moisture |
|---|---|---|---|---|---|---|---|
| — | — | — | 1.26 | 2.61 | 1.9 | — | 7.2 |
| L | 0.06 | 0.03 | 0.89 | 1.92 | 1.6 | −16% | 7.6 |
| M | 0.03 | 0.03 | 1.15 | 2.70 | 2.3 | +21% | 7.5 |
| N | 0.075 | 0.03 | 1.32 | 2.36 | 1.9 | — | 6.8 |
| G | 0.06 | 0.03 | 0.94 | 2.50 | 2.2 | +16% | 7.3 |
| O | 0.169 | 0.03 | 1.49 | 2.35 | 2.7 | +42% | 7.3 |
| P | 0.169 | 0.03 | 1.26 | 2.50 | 2.6 | +37% | 6.8 |

These results again show that the Binders O and P of the invention give a significant improvement in drop number, even in comparison with other binders in which the pellets have a greater moisture content. In particular improvements are shown over the standard commercial products L and M.

EXAMPLE 4

Tests were carried out as in Example 3.

The following binders were used in this example. Binders C, G and L to P are the same as the binders with the same letters in previous examples.

Q As L, with small amount of MBA cross-linking.

The wet and dry strength and drop number values were recorded. The results are given in the following Table 4.

TABLE 4

| Binder | % Dose | % Active Dose | Strength/kg Wet | Strength/kg Dry | Drop Number | % Change in Drop Number | % Moisture |
|---|---|---|---|---|---|---|---|
| — | — | — | 1.34 | 2.94 | 1.4 | — | 7.1 |
| L | 0.06 | 0.03 | 1.07 | 2.30 | 1.9 | +36% | 8.0 |
| M | 0.03 | 0.03 | 1.07 | 2.57 | 2.0 | +43% | 7.8 |
| N | 0.075 | 0.03 | 1.52 | 2.49 | 1.8 | +29% | 6.8 |
| G | 0.06 | 0.03 | 1.03 | 2.97 | 2.0 | +43% | 7.5 |
| O | 0.169 | 0.03 | 1.52 | 2.46 | 2.9 | +107% | 7.1 |
| P | 0.169 | 0.03 | 1.54 | 2.57 | 2.9 | +107% | 7.3 |
| C | 0.20 | 0.20 | 1.24 | 2.22 | 1.5 | +7% | 7.6 |
| Q | 0.06 | 0.03 | 1.03 | 2.65 | 1.6 | +14% | 7.2 |

Again these results show that the Polymers O and P of the invention give significantly improved drop number even at relatively low moisture contents. In particular they give improvements over the standard commercial products L, M and Q.

In all of these examples, the moisture contents obtained are at the low end of the range which is typically seen. For pellets having these moisture contents drop numbers tend generally to be low, so any significant improvements are particularly advantageous.

What is clamed is:

1. A process of pelletising a metal ore comprising forming an intimate mixture of particulate ore and a binder in the presence of moisture, forming green pellets by agitation of the mixture and firing the green pellets to produce ore pellets, wherein the binder comprises a polymer made from water soluble ethylenically unsaturated monomer or monomer blend and which has pendent groups of the formula

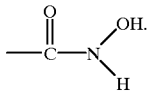

2. A process according to claim 1 in which the polymer consists of recurring units which are 20 to 100 mol % hydroxamated (meth) acrylamide units, 0 to 80 mol % (meth) acrylamide units and 0 to 50 mol % other units derived from water soluble ethylenically unsaturated monomer.

3. A process according to claim 1 in which the polymer is a copolymer of 50 to 100 mol % hydroxamated acrylamide units, 0 to 20 mol % sodium acrylate units and 0 to 50 mol % acrylamide units.

4. A process according to claim 1 in which the polymer has intrinsic viscosity above 4 dl/g.

5. A process according to claim 1 in which the polymer is cross linked.

6. A process according to claim 1 in which the polymer is supplied as an emulsion of the polymer in an oil phase and this emulsion is mixed with the particulate ore.

7. A process according to claim 1 in which the mixture of binder and ore includes lime.

8. A process according to claim 1 in which the amount of moisture in the mixture of ore and binder is below 9% based on the weight of the ore.

9. A process according to claim 8 in which the amount of moisture in the mixture of ore and binder is in the range of 6 to 8.3%, based on the weight of ore.

* * * * *